US007017479B2

(12) United States Patent
Kuosa

(10) Patent No.: US 7,017,479 B2
(45) Date of Patent: Mar. 28, 2006

(54) CALENDER

(75) Inventor: Harri Kuosa, Järvenpää (JP)

(73) Assignee: Metso Paper, Inc., Helsinki (FI)

( * ) Notice: Subject to any disclaimer, the term of this patent is extended or adjusted under 35 U.S.C. 154(b) by 96 days.

(21) Appl. No.: 10/486,280

(22) PCT Filed: Aug. 7, 2002

(86) PCT No.: PCT/FI02/00656

§ 371 (c)(1),
(2), (4) Date: Feb. 9, 2004

(87) PCT Pub. No.: WO03/016621

PCT Pub. Date: Feb. 27, 2003

(65) Prior Publication Data

US 2004/0244610 A1 Dec. 9, 2004

(30) Foreign Application Priority Data

Aug. 16, 2001 (FI) ..... 20010315 U

(51) Int. Cl.
*B30B 3/04* (2006.01)

(52) U.S. Cl. ..... 100/158 R; 100/159; 100/161; 100/331

(58) Field of Classification Search ..... 100/155 R, 100/159, 158 R, 161, 162 R, 331, 167, 168, 100/169, 176; 162/206, 361; 72/232, 237
See application file for complete search history.

(56) References Cited

U.S. PATENT DOCUMENTS 3,270,664 A 9/1966 Veneman et al.
4,211,165 A * 7/1980 Schill ..... 100/162 R

FOREIGN PATENT DOCUMENTS

| | | |
|---|---|---|
| EP | 0 027 270 | 10/1980 |
| FI | 74066 | 8/1987 |
| FI | 992214 | 10/1999 |
| WO | WO 01/27389 | 4/2001 |

(Continued)

OTHER PUBLICATIONS

International Preliminary Examination Report issued in PCT/F102/00656.

(Continued)

*Primary Examiner*—Derris H. Banks
*Assistant Examiner*—Jimmy Nguyen
(74) *Attorney, Agent, or Firm*—Stiennon & Stiennon

(57) ABSTRACT

A soft calender has a body structure (10) and at least two roller sets (11; 12). There is at least one calendering nip (N1, N2, N3, N4) formed in between two rollers (13, 14; 14, 15; 16, 17; 17, 18). Of the rollers forming the nip, at least one is a roller with a soft surface (13, 15; 16, 18) and the other is a heating roller (14, 17). The calender body structure (10) is formed with a stepped shape in such a way that the roller sets (11, 12) can be located in an upper and a lower place of location (21) on the same side of the body.

21 Claims, 1 Drawing Sheet

U.S. PATENT DOCUMENTS 4,332,191 A * 6/1982 Kankaanpaa ..... 100/162 R
4,375,188 A 3/1983 Leiviskä
4,606,264 A 8/1986 Agronin et al.
5,024,150 A * 6/1991 Brendel et al. ..... 100/35
5,609,098 A * 3/1997 Abe et al. ..... 100/331
5,911,174 A * 6/1999 Cramer et al. ..... 100/331
6,578,473 B1 6/2003 Strebel
6,688,218 B1 * 2/2004 Svenka et al. ..... 100/155 R

FOREIGN PATENT DOCUMENTS

WO WO 03/016621 2/2003

OTHER PUBLICATIONS

International Search Report issued in PCT/F102/00656.

* cited by examiner

CALENDER

CROSS REFERENCES TO RELATED APPLICATIONS

This application is a U.S. national stage application of International Application No. PCT/FI02/00656, filed Aug. 7, 2002, and claims priority on Finnish Application No. U20010315, Filed Aug. 16, 2001.

FEDERALLY SPONSORED RESEARCH AND DEVELOPMENT

Not applicable.

BACKGROUND OF THE INVENTION

This invention concerns a calender, especially a soft calender including a body structure and at least two roller sets, wherein there is at least one calendering nip formed in between two rollers, and of the rollers forming the nip at least one is a roller with a soft surface and the other roller is a heating roller.

As is known in the state of the art, in the after-treatment of fibre webs, especially paper and board webs, calenders are used in order to increase the smoothness and evenness of the web surface. Of the rollers forming the calender nip in the soft calender, at least one of the rollers forming the nip has a soft surface. The soft calender nip is usually formed by at least one variable crown roller having a soft surface coating and by a heating chill roller. Multi-zone roller technology known as such is used for the thickness calibration of the web. In soft calendering, the mechanism affecting the web surface consists of compression and copying. High temperatures can be utilised in soft calendering, and this is mainly applied with such grades, which were earlier calendered by machine-finishing, and it is suitable e.g. for calendering of newsprint and fine grade papers as well as various kinds of board. Single-nip and double-nip as well as multi-nip soft calenders of many different types are known in the state of the art.

One known soft calender is presented in the FI Patent Publication 74066, which describes an arrangement, wherein the web consisting of paper or other such material is subjected to the effect of at least one nip, which nip is formed by an iron roller and a flexible roller. The iron roller is heated at least to such a temperature, at which the shape of fibres begins to change. With paper this is approximately (177° C.) 350° F. The web is preferably run between two nips, whereby the first nip will polish one side of the web while the other nip will polish the other side. In this way a minimum-stippled web is obtained having improved gloss without any loss of bulk.

Another known soft calender, especially an arrangement and adaptation for fastening a calender roller, is presented in the FI Application Publication 992214, in which known calender there are at least two calender nips formed by at least two superimposed rollers, bearing housings used for combining the rollers to form roller pairs forming calender nips and parts for fastening together the bearing housings of the roller pairs. In this known calender at least two successive calender nips are arranged in such a way that the distance between the center lines of the lower rollers in the successive nips is shorter than the distance between the center lines of the rollers located above them, whereby as seen from the roller end faces the rollers are in a V position and a space is formed between the nips for replacement of the rollers.

Nowadays when using calenders, especially soft calenders, as an on-line after treatment device in lines for making paper or board webs, one important factor is the time used for exchanging the rollers. The time used for exchanging the rollers reduces the production capacity, and for this reason it is important to minimise the time spent for exchanging rollers in the calender. It is of course important also with off-line calenders to minimise the time spent for exchanging the rollers.

The invention aims at bringing about a calender, where the rollers are exchanged quickly.

Nowadays calendering of different types is also needed to make different paper grades, whereby versatility of the calender is an important feature.

The invention also aims at bringing about a calender, which is easily converted.

SUMMARY OF THE INVENTION

In order to achieve the objectives presented above and objectives emerging later the calender according to the invention is mainly characterised in that the body structure of the calender is given a stepped shape, so that the roller sets can be located in upper and lower positions on the same side of the body.

In the calender according to the invention the rollers are locked to the body with a quick-release lock, whereby the rollers can be exchanged quickly. The rollers are located and attached to the calender body in such a way that all rollers can also be exchanged directly by using a hoisting device, without any special carriages or other such additional equipment.

The body structure of the machine according to the invention allows an arrangement, wherein the machine is delivered equipped with calender nips formed by two rollers, but the body structure easily allows expansion of the calender to include three rollers, whereby the roller set will form two calendering nips.

In the calender according to the invention the body structure is formed in such a way that two roller sets can be located in it one on top of the other in the vertical direction at two different planes of location, and so that lines drawn through the center lines of the rollers in the roller sets are at a distance from each other. Hereby the body structure of the calender is thus of a "stepped shape" consisting of a lower step, where one roller set is located, and an upper step, where another roller set is located. Each step is formed as recesses made in the body, whereby the topmost roller in the roller set can be attached to the recess ceiling and the thermal roller either to wall structures or to the floor in a two-roller set of rollers, and in a three-roller set of rollers the thermal roller is attached to the wall structures, whereas the lowermost roller is attached to the floor plane of the recess.

The calender arrangement according to the invention allows use of a large nip pressure area, because each nip can be put into operation individually and can be loaded from the minimum nip pressure all the way to the maximum nip pressure independently of the load of the other nips. The maximum nip pressure is determined by the strength of the rollers and it can be limited by an overload carriage.

BRIEF DESCRIPTION OF THE DRAWINGS

In the following, the invention is described in greater detail with reference to the appended figures.

DESCRIPTION OF THE PREFERRED EMBODIMENTS

Figure 1:
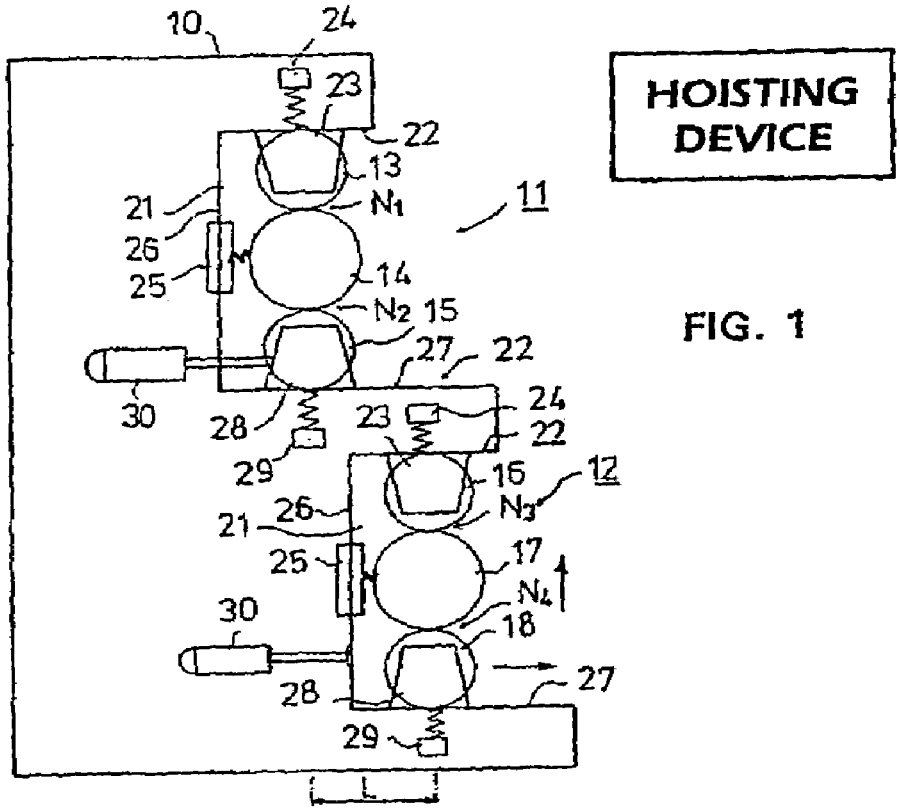
FIG. 1 is a schematic view of one application of the invention.

In FIG. 1, two roller sets 11, 12 are arranged in the calender body 10 one on top of the other, so that each roller set forms two calendering nips N1, N2; N3, N4. In the upper place of location 21 of the calender body 10, the first roller set 11 is located, where a soft, e.g. a sym roller 13, is attached to the ceiling 22 by a ceiling mounting 23 and by quick-release locks 24. The thermal roller 14 forming the calendering nip N1 together with roller 13 is attached by an overload carriage 25 to the side wall 26 of the place of location 21 in calender body 10, and the soft roller 15 forming the other calendering nip N2 together with thermal roller 14 is attached to the floor plane 27 of the upper level, that is, the upper place of location 21, by mounting parts 28 and quick-release locks 29 and it is equipped with an ejection cylinder 30.

In a similar manner a second roller set 12 is arranged in the lower part of the stepped-shape calender body 10, that is, at the lower place of location 21, in which roller set 12 there are a thermal roller 17 and an upper soft roller 16 and a lower soft roller 18, whereby calendering nips N3 and N4 are formed. The mounting arrangements of the rollers 16, 17, 18 in roller set 12 correspond with the mounting arrangements of the rollers 13, 14, 15 in the upper roller set 11, and the same reference numbers are used for the corresponding parts.

Each roller 13, 14, 15; 16, 17, 18 is attached by a quick-release lock or other such locking device 24, 25, 29, which can be quickly opened and locked, to calender body 10, whereby they are easily and quickly replaced, and the shape of body 10 is such that each roller 13, 14, 15; 16, 17, 18 can be moved away from its position directly with the aid of a hoisting device. The lowest roller 15, 18 in each roller set 11, 12 is equipped with an ejection cylinder 30 and the thermal roller 14, 17 is attached to the body 10 by an overload carriage 25.

The body structure 10 of the calender has a stepped shape, so that the lower place of location 21 and the upper place of location 21 are formed as recesses with a stepped shape, into which recesses the roller sets of the calender are located in such a way that lines going through the center lines of the rollers in the roller set are at a distance from each other. The distance L is 0.2–3 m, preferably 0.3–1.5 m.

Figure 2:
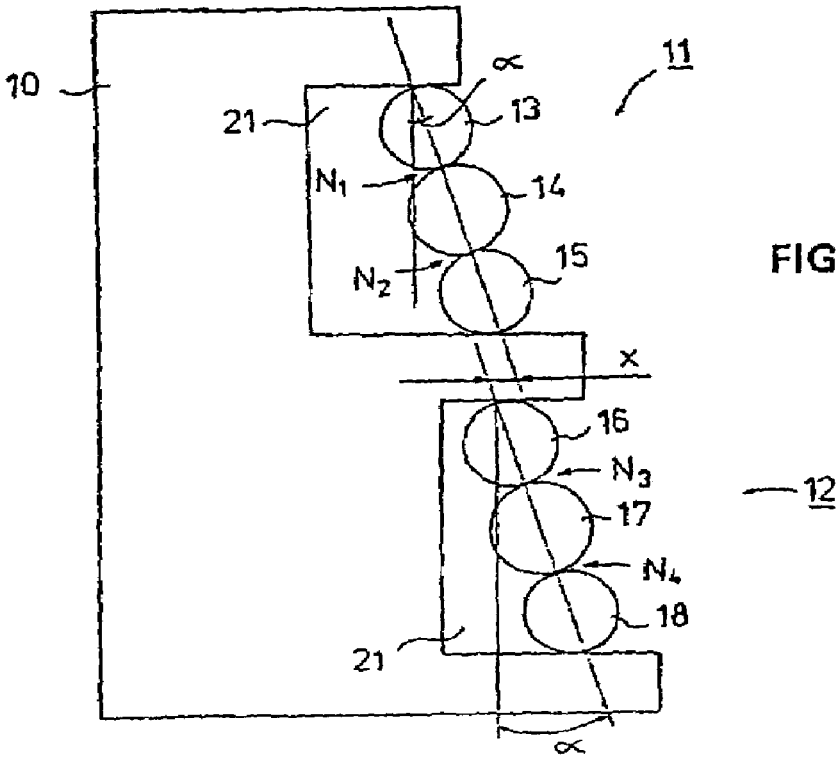
FIG. 2 is a schematic view of another application of the invention.

FIG. 2 is a schematic view of another application example of the invention. As regards its main principles the application example shown in FIG. 2 is similar to the one shown in FIG. 1, and for the sake of clarity some of the structural features and reference numbers are left out from FIG. 2. Parts corresponding to one another are marked by the same reference numbers in FIGS. 1 and 2. In FIG. 2, the rollers 13, 14, 15; 16, 17, 18 of the roller sets 11, 12 in the calender are in a tilted position in relation to the vertical plane, that is, lines passing through the center lines of the rollers are at an angle $\alpha$ to the vertical direction. Angle $\alpha$ is 0–30°, preferably 0–20°. In this application example of the invention the distance x between lines going through the center lines of the rollers 13, 14, 15; 16, 17, 18 of the roller sets 11; 12 may also be 0. As regards its other essential structural features the application example shown in FIG. 2 is thus similar to the one shown in FIG. 1.

The application shown in the figures is an application with 3+3 rollers, but the body structure 10 also allows easy arrangement of the calender with 2+2 rollers.

In the foregoing, the invention was described referring to only one advantageous application example of the invention, but the intention is not in any way to limit the invention narrowly to its details.

What is claimed is:

1. A calender comprising:

a body structure having a side, and portions forming a lower step recessed into the side of the body structure, the lower step having a recess ceiling, a side wall, and a floor plane, the lower step forming a lower place of location;

a first roller with a soft surface mounted in the lower step;

a first heated roller mounted within the lower step to define a first nip with the first roller with a soft surface;

an upper step formed of portions of the body structure, the upper step being positioned above the lower step and recessed into the side of the body structure, the upper step having a recess ceiling, a side wall, and a floor plane, the upper step forming an upper place of location;

a second roller with a soft surface mounted in the upper step; and a second heated roller mounted within the upper step to define a second nip with the second roller with a soft surface.

2. The calender of claim 1, wherein the first roller with a soft surface, the first heated roller, the second roller with a soft surface, and the second heated roller of the calender are each attached by a quick-release mounting to the body structure of the calender.

3. The calender of claim 1, wherein the the first roller with a soft surface is attached to the lower step recess ceiling by a ceiling mounting with a quick-release lock.

4. The calender of claim 1, wherein the the first heated roller is attached by an overload carriage to the side wall of the lower step of the body structure.

5. The calender of claim 1, wherein the first heated roller forms a futher nip with a third roller with a soft surface.

6. The calender of claim 5, wherein the first roller with a soft surface is located above the first heated roller and and the third roller with a soft surface is located below the first heated roller, and the third roller with a soft surface is equipped with an ejection cylinder for aiding replacement of said third roller with a soft surface.

7. The calender of claim 1, wherein the rollers are attached to the body structure so that they can be hoisted directly by a hoisting device when the rollers are exchanged.

8. The calender of claim 1, wherein the first roller with a soft surface has a first center line and the first heated roller has a second center line, said first center line and said second center line defining a first plane going through said first center line and said second center line;

wherein the second roller with a soft surface has a third center line and the second heated roller has a fourth center line said third center line and said fourth center line defining a second plane going through said third center line and said fourth center line; and wherein the first plane and the second plane are parallel to each other and vertical.

9. The calender of claim 8, wherein a shortest distance between the first plane and the second plane is 0.2–3 m.

10. The calender of claim 8, wherein a shortest distance between the first plane and the second plane is 0.3~1.5 m.

11. The calender of claim 1, wherein the first roller with a soft surface has a first center line and the first heated roller has a second center line, said first center line and said second center line defining a first plane going through said first center line and said second center line;

wherein the second roller with a soft surface has a third center line and the second heated roller has a fourth center line, said third center line and said fourth center line defining a second plane going through said third center line and said fourth center line;

wherein the first plane and the second plane are parallel to each other and the first plane and the second plane are at an angle of less than 30°, in relation to a vertical direction.

12. The calender of claim 11, wherein the first plane and the second plane are at an angle of less than 20°, in relation to a vertical direction.

13. A calender having a body structure on which rolls are mounted comprising:

the body structure having a side, the side of the body structure having a stepped shape formed by portions of the body structure forming a lower step recessed into the side of the body structure, the lower step having a recess ceiling, a side wall, and a floor plane, and portions of the body structure forming an upper step positioned above the lower step, the upper step recessed into said side of the body structure, the upper step having a recess ceiling, a side wall, and a floor plane wherein the upper step is set further back into the the side of the body structure than the lower step;

the lower step forming a lower place of location in which is mounted a first roller with a soft surface and a first heated roller forming a first roll set and a first nip; and the upper step forming an upper place of location in which is mounted a second roller with a soft surface and a second heated roller forming a second roll and a second nip.

14. The calender of claim 13, wherein the first roller with a soft surface is attached to the step recess ceiling of the lower step by a ceiling mounting.

15. The calender of claim 14, wherein the the first heated roller is attached by an overload carriage to the side wall of the lower step of the body structure.

16. The calender of claim 15, wherein the first heated roller forms a further nip with a third roller with a soft surface mounted to the floor plane of the lower step.

17. The calender of claim 16, wherein the second roller with a soft surface is attached to the step recess ceiling of the upper step by a ceiling mounting.

18. The calender of claim 17, wherein the the second heated roller is attached by an overload carriage to the side wall of the upper step of the body structure.

19. The calender of claim 18, wherein the second heated roller forms a further nip with a third roller with a soft surface mounted to the floor plane of the upper step.

20. The calender of claim 13, wherein the first roller with a soft surface has a first center line and the first heated roller has a second center line said first center line and said second center line defining a first plane going through said first center line and said second center line;

wherein the second roller with a soft surface has a third center line and the second heated roller has a fourth center line, said third center line and said fourth center line defining a second plane going through said third center line and said fourth center line;

wherein the first plane and the second plane are parallel to each other and vertical.

21. The calender of claim 20, wherein a shortest distance between the first plane and the second plane is 0.3–1.5 m.

* * * * *